US010469942B2

(12) United States Patent
Bezzola

(10) Patent No.: US 10,469,942 B2
(45) Date of Patent: Nov. 5, 2019

(54) THREE HUNDRED AND SIXTY DEGREE HORN FOR OMNIDIRECTIONAL LOUDSPEAKER

(71) Applicant: Samsung Electronics Co., Ltd., Suwon-si, Gyeonggi-do (KR)

(72) Inventor: Andri Bezzola, Pasadena, CA (US)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 368 days.

(21) Appl. No.: 15/141,611

(22) Filed: Apr. 28, 2016

(65) Prior Publication Data

US 2017/0094406 A1 Mar. 30, 2017

Related U.S. Application Data

(60) Provisional application No. 62/233,959, filed on Sep. 28, 2015.

(51) Int. Cl.
*H04R 1/34* (2006.01)
*H04R 1/40* (2006.01)
(Continued)

(52) U.S. Cl.
CPC ..... *H04R 1/345* (2013.01); *G10K 11/025* (2013.01); *G10K 11/28* (2013.01); *H04R 1/30* (2013.01);
(Continued)

(58) Field of Classification Search
CPC . H04R 1/30; H04R 1/34; H04R 1/345; H04R 9/063; H04R 2201/029; H04R 2201/34; G10K 11/025; G10K 11/028; G10K 11/28
USPC ..... 381/337, 340, 341, 342, 343, 182, 160, 381/186; 181/152, 153, 155, 159, 177, 181/191, 192, 199
See application file for complete search history.

(56) References Cited

U.S. PATENT DOCUMENTS 3,477,540 A * 11/1969 Rizo-Patron ..... H04R 1/20 181/144
3,649,776 A 3/1972 Burton
(Continued)

FOREIGN PATENT DOCUMENTS

DE 1079675 B 4/1960
EP 0474029 A2 3/1992
(Continued)

OTHER PUBLICATIONS

U.S. Non-Final Office Action for U.S. Appl. No. 15/141,594 dated Jun. 12, 2017.
(Continued)

*Primary Examiner* — Huyen D Le
(74) *Attorney, Agent, or Firm* — Sherman IP LLP; Kenneth L. Sherman; Hemavathy Perumal

(57) ABSTRACT

One embodiment provides an omnidirectional loudspeaker comprising a first axisymmetric reflector, a second axisymmetric reflector, a sound source in the first axisymmetric reflector or the second axisymmetric reflector, and a horn including a straight section and a growth section extending from a distal end of the straight section. The growth section comprises one or more curves that are scaled with a radial coordinate and that expands sound waves generated by the sound source.

18 Claims, 14 Drawing Sheets

(51) Int. Cl.

| | |
|---|---|
| ***H04R 31/00*** | (2006.01) |
| ***H04R 1/30*** | (2006.01) |
| ***G10K 11/28*** | (2006.01) |
| ***G10K 11/02*** | (2006.01) |

(52) U.S. Cl.
CPC ..... *H04R 1/34* (2013.01); *H04R 1/403* (2013.01); *H04R 31/00* (2013.01); *H04R 2201/029* (2013.01)

(56) References Cited

U.S. PATENT DOCUMENTS

| | | | | |
|---|---|---|---|---|
| 3,912,866 | A | 10/1975 | Fox | |
| 4,157,741 | A | 6/1979 | Goldwater | |
| 4,322,578 | A | 3/1982 | Selmin | |
| 4,336,861 | A | 6/1982 | Peter | |
| 4,348,549 | A | 9/1982 | Berlant | |
| 4,348,750 | A | 9/1982 | Schwind | |
| 4,876,723 | A | 10/1989 | Fang | |
| 5,115,882 | A | 5/1992 | Woody | |
| 5,261,006 | A | 11/1993 | Nieuwendjk et al. | |
| 5,298,690 | A * | 3/1994 | Klein | H04R 1/345 181/152 |
| 5,306,880 | A | 4/1994 | Coziar et al. | |
| 5,451,726 | A | 9/1995 | Haugum | |
| 5,521,983 | A | 5/1996 | Thompson et al. | |
| 5,673,329 | A | 9/1997 | Wiener | |
| 5,886,304 | A | 3/1999 | Schlenzig | |
| 5,952,620 | A | 9/1999 | Hamilton | |
| 5,995,634 | A | 11/1999 | Zwolski | |
| 6,009,972 | A | 1/2000 | Choi et al. | |
| 6,026,928 | A | 2/2000 | Maharaj | |
| 6,785,397 | B2 | 8/2004 | Arnstein | |
| 6,820,718 | B2 | 11/2004 | Lacarrubba | |
| 6,950,530 | B2 | 9/2005 | Baird et al. | |
| 7,236,606 | B2 | 6/2007 | Werner | |
| 7,587,227 | B2 | 9/2009 | Cheung | |
| 7,614,479 | B2 | 11/2009 | Plummer | |
| 7,920,712 | B2 | 4/2011 | Butler | |
| 8,014,545 | B2 | 9/2011 | Grant | |
| 8,027,500 | B2 | 9/2011 | Fincham | |
| 8,081,766 | B2 | 12/2011 | Gunness | |
| 8,116,500 | B2 | 2/2012 | Oxford et al. | |
| 8,121,330 | B2 | 2/2012 | Dodd et al. | |
| 8,130,994 | B2 | 3/2012 | Chick et al. | |
| 8,181,736 | B2 | 5/2012 | Sterling et al. | |
| 8,199,953 | B2 | 6/2012 | Buccafusca | |
| 8,280,091 | B2 | 10/2012 | Voishvillo | |
| 8,428,284 | B2 | 4/2013 | Meyer et al. | |
| 8,467,557 | B2 | 6/2013 | Miller | |
| 8,638,959 | B1 | 1/2014 | Hall | |
| 8,672,088 | B2 | 3/2014 | Sterling et al. | |
| 8,750,540 | B2 | 6/2014 | Tan | |
| 8,857,559 | B2 | 10/2014 | Reviel | |
| 8,873,787 | B2 | 10/2014 | Bergere | |
| 9,060,219 | B2 | 6/2015 | Guenther | |
| 9,173,018 | B2 | 10/2015 | Silver et al. | |
| 9,282,398 | B2 | 3/2016 | Monroe | |
| 9,544,681 | B2 | 1/2017 | Kim | |
| 9,549,242 | B2 | 1/2017 | Silver et al. | |
| 2002/0118858 | A1 | 8/2002 | White | |
| 2005/0175207 | A1 | 8/2005 | Alexander et al. | |
| 2008/0107291 | A1 | 5/2008 | Livingston | |
| 2008/0192972 | A1 | 8/2008 | Lewallen | |
| 2010/0027833 | A1 | 2/2010 | Takahashi | |
| 2011/0019854 | A1 | 1/2011 | Graber | |
| 2012/0219171 | A1 | 8/2012 | Velican | |
| 2013/0228393 | A1 | 9/2013 | Sterling et al. | |
| 2014/0003645 | A1 | 1/2014 | Silver et al. | |
| 2014/0029781 | A1 * | 1/2014 | Valtchev | H04R 1/227 381/341 |
| 2014/0185854 | A1 | 7/2014 | Murphy | |
| 2017/0006376 | A1 * | 1/2017 | Tan | H04R 1/20 |
| 2017/0094403 | A1 | 3/2017 | Tipparagju | |

FOREIGN PATENT DOCUMENTS

| | | | |
|---|---|---|---|
| EP | 0485284 | A1 | 5/1992 |
| EP | 0474029 | A3 | 12/1992 |
| JP | S6135699 | A | 2/1986 |
| JP | 2004343229 | A | 12/2004 |
| KR | 101510692 | B1 | 4/2015 |
| WO | 1987003994 | A1 | 7/1987 |
| WO | 2015094115 | A | 6/2015 |

OTHER PUBLICATIONS

International Search Report and Written Opinion dated Dec. 29, 2016 for International Application No. PCT/KR2016/010650 from Korean Intellectual Property Office, pp. 1-12, Daejeon, Republic of Korea.

U.S. Notice of Allowance for U.S. Appl. No. 15/141,594 dated Apr. 2, 2018.

U.S. Final Office Action for U.S. Appl. No. 15/141,594 dated Dec. 6, 2017.

Korean Office Action dated Nov. 30, 2018 for Korean Patent Application No. 10-2018-7008878 from Korean Patent Office, pp. 1-14, Seoul, South Korea (English-language translation included pp. 1-7).

Extended European Search Report dated Jul. 4, 2018 for European Application No. 16852022.9 from European Patent Office, pp. 1-9, Munich, Germany.

Korean Notice of Allowance dated Feb. 27, 2019 for Korean Patent Application No. 10-2018-7008878 from Korean Patent Office, pp. 1-6, Beijing, China.

Chinese Office Action dated Apr. 1, 2019 for Chinese Patent Application No. 201680056572.9 from China Patent Office, pp. 1-8, Beijing, China.

European Office Action dated Mar. 27, 2019 for European Patent Application No. 16852022.9 from European Patent Office, pp. 1-5, Munich, Germany.

* cited by examiner

THREE HUNDRED AND SIXTY DEGREE HORN FOR OMNIDIRECTIONAL LOUDSPEAKER

CROSS-REFERENCE TO RELATED APPLICATIONS

The present application claims priority to U.S. Provisional Patent Application No. 62/233,959, filed on Sep. 28, 2015. Further, the present application is related to commonly-assigned, co-pending U.S. Non-Provisional Patent Applications entitled "ACOUSTIC FILTER FOR OMNIDIRECTIONAL LOUDSPEAKER", filed on the same day as the present application. Both patent applications are hereby incorporated by reference in its entirety.

TECHNICAL FIELD

One or more embodiments relate generally to loudspeakers, and in particular, to a three hundred and sixty degree (360°) horn for an omnidirectional loudspeaker.

BACKGROUND

A loudspeaker reproduces audio when connected to a receiver (e.g., a stereo receiver, a surround receiver, etc.), a television (TV) set, a radio, a music player, an electronic sound producing device (e.g., a smartphone), video players, etc. A loudspeaker may comprise a speaker cone, a horn or another type of device that forwards most of the audio reproduced towards the front of the loudspeaker.

A conventional directional horn for a loudspeaker has a throat and a mouth. A shape of an area of the horn at any position along a centerline may have infinite degrees of freedom. A shape of an area of the horn may be square, rectangular, circular, oval or any other shape, depending on an application of the horn.

SUMMARY

One embodiment provides an omnidirectional loudspeaker comprising a first axisymmetric reflector, a second axisymmetric reflector, a sound source in the first axisymmetric reflector or the second axisymmetric reflector, and a horn including a straight section and a growth section extending from a distal end of the straight section. The growth section comprises one or more curves that are scaled with a radial coordinate and that expands sound waves generated by the sound source.

Another embodiment provides a horn device for an omnidirectional loudspeaker. The horn device comprises a straight section and a growth section extending from a distal end of the straight section. The growth section comprises one or more curves that are scaled with a radial coordinate and that expands sound waves generated by a sound source of the loudspeaker.

One embodiment provides a method for producing a horn for an omnidirectional loudspeaker. The method comprises identifying resonances and acoustic nulls in a straight slot of the omnidirectional loudspeaker to remove, determining a horn profile suitable for removing the identified resonances and acoustic nulls based on an application and a size of the omnidirectional loudspeaker, and fabricating a horn for the omnidirectional loudspeaker in accordance with the horn profile determined. The horn has a straight section and a growth section extending from a distal end of the straight section. The growth section comprises one or more curves that are scaled with a radial coordinate and that expands sound waves generated by a sound source of the omnidirectional loudspeaker.

Another embodiment provides a method for creating uniform sound in a horizontal plane and a vertical plane. The method comprises generating, utilizing a sound source of an omnidirectional loudspeaker, sound waves that propagate radially along a straight section of a horn for the omnidirectional loudspeaker. The method further comprises forcing the sound waves, within the straight section, to become cylindrical sound waves with a wave front that is parallel to an axis of symmetry. The method further comprises forcing the sound waves to grow exponentially within a growth section of the horn until the sound waves exit an outer circumference of the horn.

These and other features, aspects and advantages of the one or more embodiments will become understood with reference to the following description, appended claims and accompanying figures.

DETAILED DESCRIPTION

Figure 1:
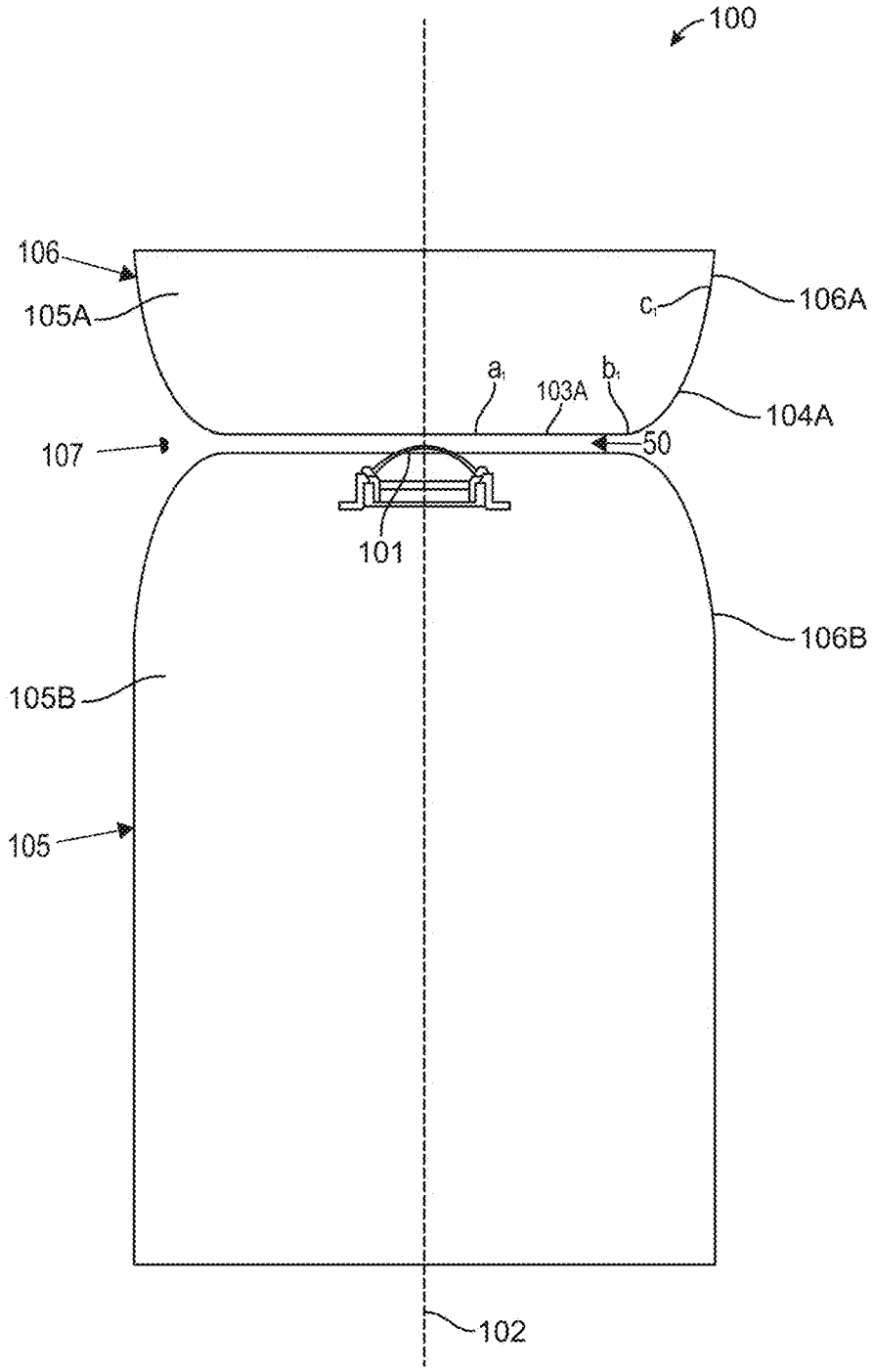
FIG. 1 illustrates a cross-section of an example omnidirectional loudspeaker, in accordance with one embodiment.

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One embodiment provides an omnidirectional loudspeaker comprising a first axisymmetric reflector, a second axisymmetric reflector, a sound source in the first axisymmetric reflector or the second axisymmetric reflector, and a horn including a straight section and a growth section extending from a distal end of the straight section. The growth section comprises one or more curves that are scaled with a radial coordinate and that expands sound waves generated by the sound source.

Another embodiment provides a horn device for an omnidirectional loudspeaker. The horn device comprises a straight section and a growth section extending from a distal end of the straight section. The growth section comprises one or more curves that are scaled with a radial coordinate and that expands sound waves generated by a sound source of the loudspeaker.

One embodiment provides a method for producing a horn for an omnidirectional loudspeaker. The method comprises identifying resonances and acoustic nulls in a straight slot of the omnidirectional loudspeaker to remove, determining a horn profile suitable for removing the identified resonances and acoustic nulls based on an application and a size of the omnidirectional loudspeaker, and fabricating a horn for the omnidirectional loudspeaker in accordance with the horn profile determined. The horn has a straight section and a growth section extending from a distal end of the straight section. The growth section comprises one or more curves that are scaled with a radial coordinate and that expands sound waves generated by a sound source of the omnidirectional loudspeaker.

Another embodiment provides a method for creating uniform sound in a horizontal plane and a vertical plane. The method comprises generating, utilizing a sound source of an omnidirectional loudspeaker, sound waves that propagate radially along a straight section of a horn for the omnidirectional loudspeaker. The method further comprises forcing the sound waves, within the straight section, to become cylindrical sound waves with a wave front that is parallel to an axis of symmetry. The method further comprises forcing the sound waves to grow exponentially within a growth section of the horn until the sound waves exit an outer circumference of the horn.

A directional loudspeaker comprises one or more sound-radiating elements, the elements spatially arranged such that each element faces the same direction. The spatial arrangement of the elements produces optimal sound in a narrow spatial region, such that a listener must be positioned within the narrow spatial region in order to experience the optimal sound. Conventional horn-type loudspeakers can be designed to have certain beam widths in the horizontal plane and/or in the vertical plane.

An omnidirectional loudspeaker produces optimal sound in all directions, such that a listener can enjoy the optimal sound regardless of his/her position relative to the loudspeaker. A conventional omnidirectional loudspeaker typically focuses on delivering sound evenly in a horizontal plane, resulting in sound power distribution in vertical planes having large peaks and dips. A listener standing close to the loudspeaker, with ears directly above the tweeter, will hear a different sound from another listener whose ears are level with the loudspeaker, especially at higher frequencies. An omnidirectional horn's beamwidth in the horizontal plane is 360 degrees by definition, which results in a reduction of degrees of freedom for the design of the horn shape.

A traditional directional loudspeaker horn is used to direct sound into a specific direction, and the extent to which the sound can be directed by the horn increases with frequency. Conventional omnidirectional/axisymmetric loudspeakers have a high peak in sound power directly on axis of symmetry, and the magnitude of the peak typically increases with frequency.

One or more embodiments of the invention provide a three hundred and sixty degree (360°) horn for an omnidirectional loudspeaker, the horn having optimal directivity in horizontal and vertical directions. With increasing frequency, the horn directs more and more sound power in a radial direction instead of an axial direction, thereby counterbalancing axial beaming in current omnidirectional loudspeakers. The horn provides a more evenly balanced sound field, i.e., the sound will be perceived the same, independent of horizontal and vertical position of a listener relative to the loudspeaker. The shape of the cross-section of the horn comprises a combination of a straight channel with continually growing curves that are scaled with a radial coordinate representing a radius extending from an axis of symmetry. Given the shape of the horn, the area that a sound wave encounters grows continually. A horn with a continually growing cross-section imposes a better impedance match for the sound source. Exponential or other area growth curves can be implemented respectively by ensuring the area growth in the horn section is scaled with the radial coordinate.

One or more embodiments of the invention extend the advantages of existing omnidirectional loudspeakers to the vertical plane. One or more embodiments of the invention allow the loudspeaker to be used with the axis of symmetry in horizontal direction, while maintaining optimal directivity in horizontal and vertical direction. One or more embodiments of the invention provide omnidirectional sound distribution in horizontal and vertical directions.

One or more embodiments of the invention improve the directivity of the sound in the vertical plane of an omnidirectional loudspeaker. One or more embodiments of the invention may be implemented without costly additional driver units. A continual growth or wave front area in the waveguide produces a smooth impedance match between the driver unit and the free air surrounding the loudspeaker.

Figure 2A:
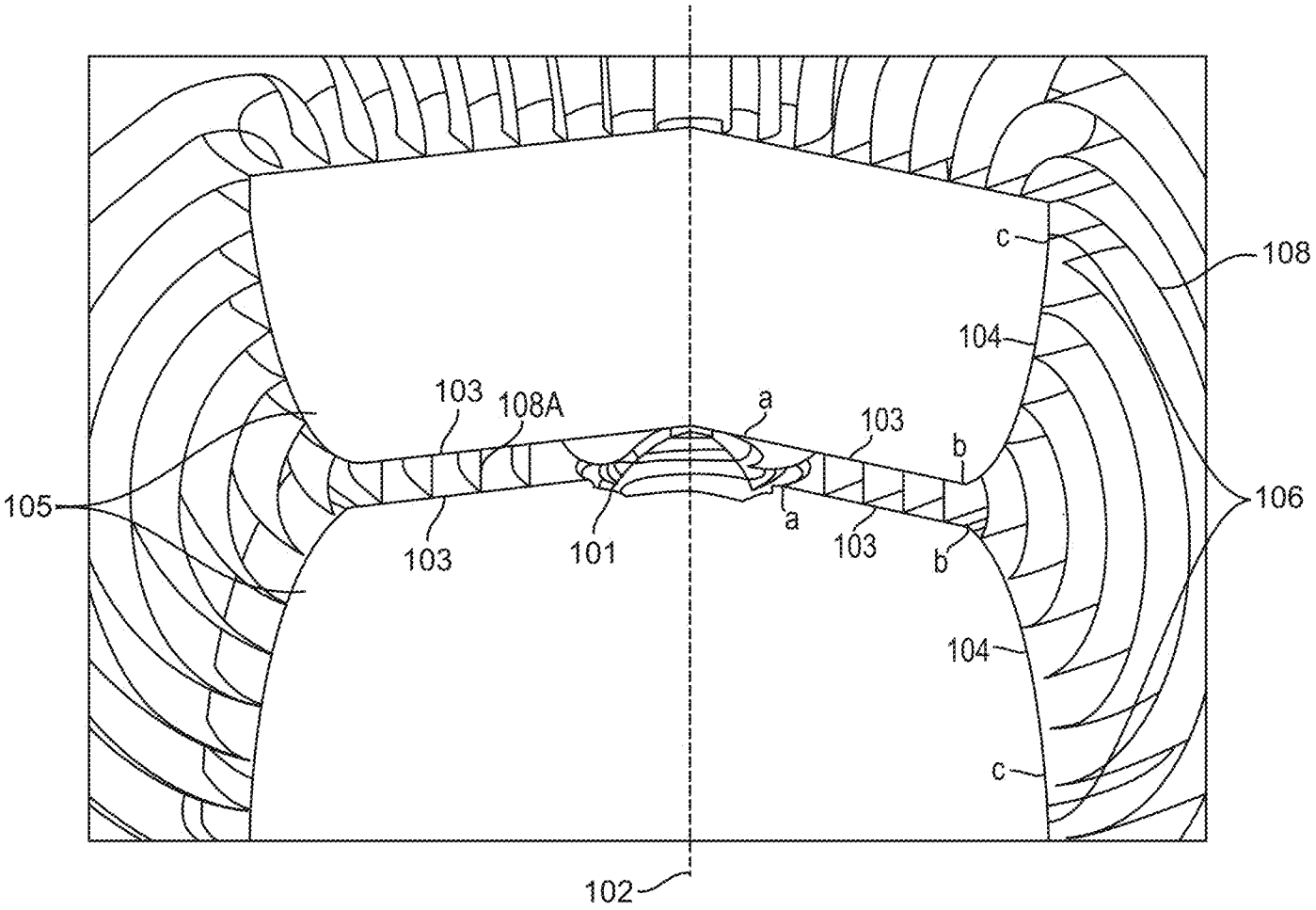
FIG. 2A illustrates a three-dimensional (3D) cutaway of the omnidirectional loudspeaker in operation with sound pressure wave fronts at a particular frequency around the loudspeaker, in accordance with one embodiment.
Figure 2B:
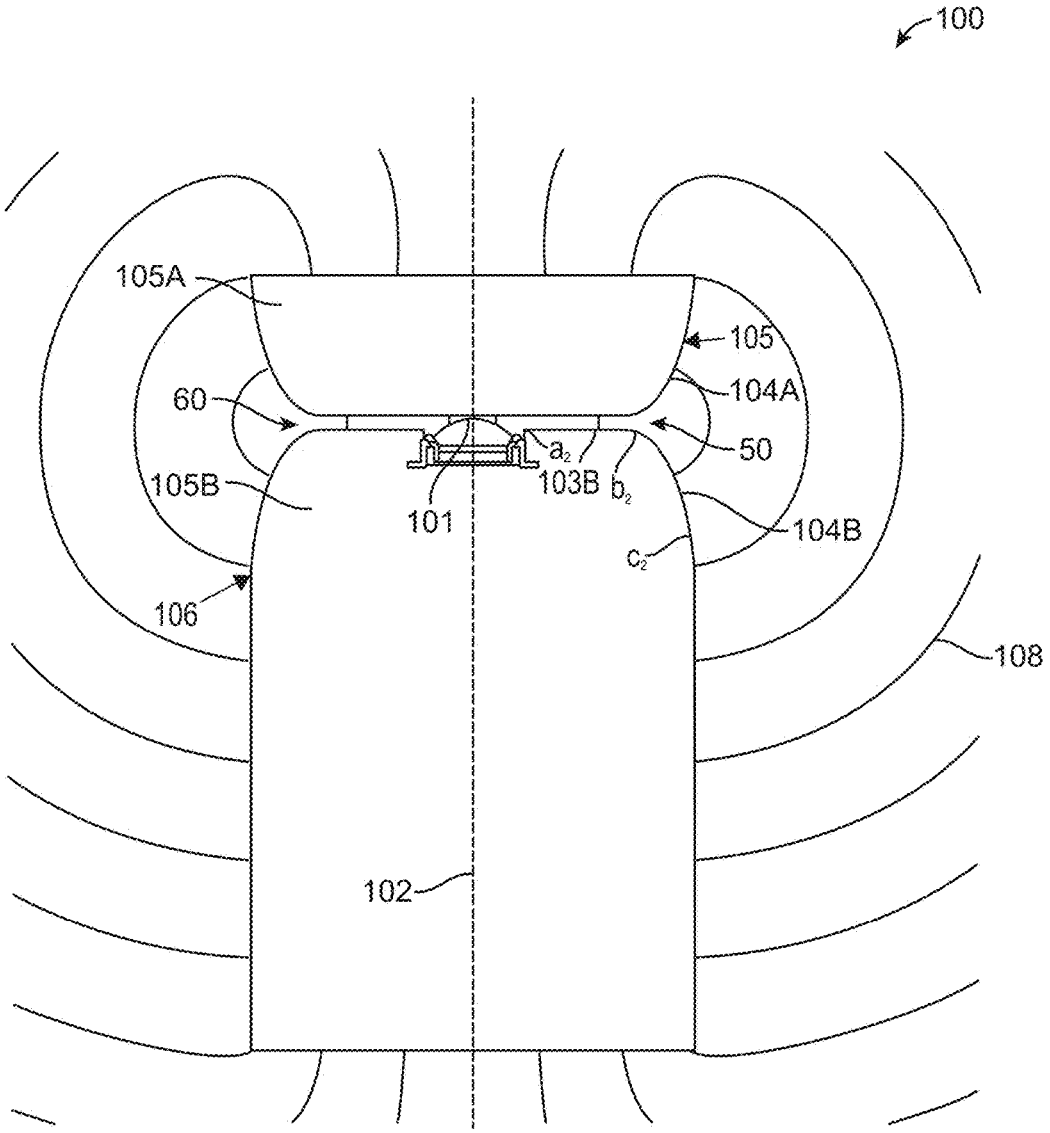
FIG. 2B illustrates a cross-section of the omnidirectional loudspeaker in operation with sound pressure wave fronts at a particular frequency around the loudspeaker, in accordance with one embodiment.

FIG. 1 illustrates a cross-section of an example omnidirectional loudspeaker 100, in accordance with one embodiment. FIG. 2A illustrates a three-dimensional (3D) cutaway of the omnidirectional loudspeaker 100 in operation with sound pressure wave fronts at a particular frequency around the loudspeaker, in accordance with one embodiment. FIG. 2B illustrates a cross-section of the omnidirectional loudspeaker 100 in operation with sound pressure wave fronts at a particular frequency around the loudspeaker, in accordance with one embodiment. The loudspeaker 100 is rotationally symmetric about an axis of symmetry 102. The loudspeaker 100 comprises multiple axisymmetric loudspeaker reflectors (i.e., enclosures) 105 (FIG. 2A). In one embodiment, the multiple axisymmetric loudspeaker reflectors 105 include a first axisymmetric cup-shaped reflector ("first reflector") 105A and a second axisymmetric cup-shaped reflector ("second reflector") 105B.

A sound source 101 (e.g., a tweeter loudspeaker driver, a woofer loudspeaker driver, etc.) is disposed within the reflector 105. In one embodiment, the sound source 101 is positioned/mounted axially in either the first reflector 105A or the second reflector 105B (as shown in FIGS. 1, 2A-2B). In one embodiment, the sound source 101 lies flush inside a reflector 105 (as shown in FIG. 5C). In another embodiment, the sound source 101 protrudes from a reflector 105 (as shown in FIG. 5B).

Each reflector 105 has an outer circumference 106 (FIG. 2A). Specifically, the first reflector 105A and the second reflector 105B has a first outer circumference 106A and a second outer circumference 106B, respectively.

The reflectors 105A and 105B combined form a horn 107 that is rotated 360° around the axis of symmetry 102. Each reflector 105A, 105B is rotationally symmetric about the axis of symmetry 102. On each opposite side of the axis of symmetry 102, each reflector 105A, 105B comprises: (1) a straight section 103 (FIG. 2A) extending between points a and b (FIG. 2A) of the reflector, and (2) a growth section 104 (FIG. 2A) extending between points b and c of the reflector. The growth section 104 may have varying rates of area growth.

Specifically, the first reflector 105A comprises: (1) a straight section 103A extending between a first point $a_1$ and a second point $b_1$ of the first reflector 105A, and (2) a growth section 104A extending between the second point $b_1$ and a third point $c_1$ of the first reflector 105A. The second point $b_1$ represents a distal end of the straight section 103A. Similarly the second reflector 105B comprises: (1) a straight section 103B (FIG. 2B) extending between a first point $a_2$ (FIG. 2B) and a second point $b_2$ (FIG. 2B) of the second reflector 105B, and (2) a growth section 104B (FIG. 2B) extending between the second point $b_2$ and a third point $c_2$ (FIG. 2B) of the second reflector 105B. The second point $b_2$ represents a distal end of the straight section 103B.

An axisymmetric cylinder may be described using a cylindrical coordinate system. A radial coordinate represents a distance between the axis of symmetry 102 and a point along a radius perpendicular to the axis of symmetry 102 (i.e., how far the point is from the axis of symmetry 102). An axial coordinate measures a location of a normal projection of a point onto the axis of symmetry 102, wherein the point is along a radius perpendicular to the axis of symmetry 102.

Each growth section 104A, 104B has continually growing curves shaped to expand sound waves produced by the sound source 101. The continually growing curves are shaped such that a distance in axial direction between the growth sections 104A and 104B increases as the radial coordinate increases. As described in detail later herein, the continually growing curves are scaled based on a radial coordinate and an area growth function corresponding to an application of the loudspeaker 100.

Figure 2C:
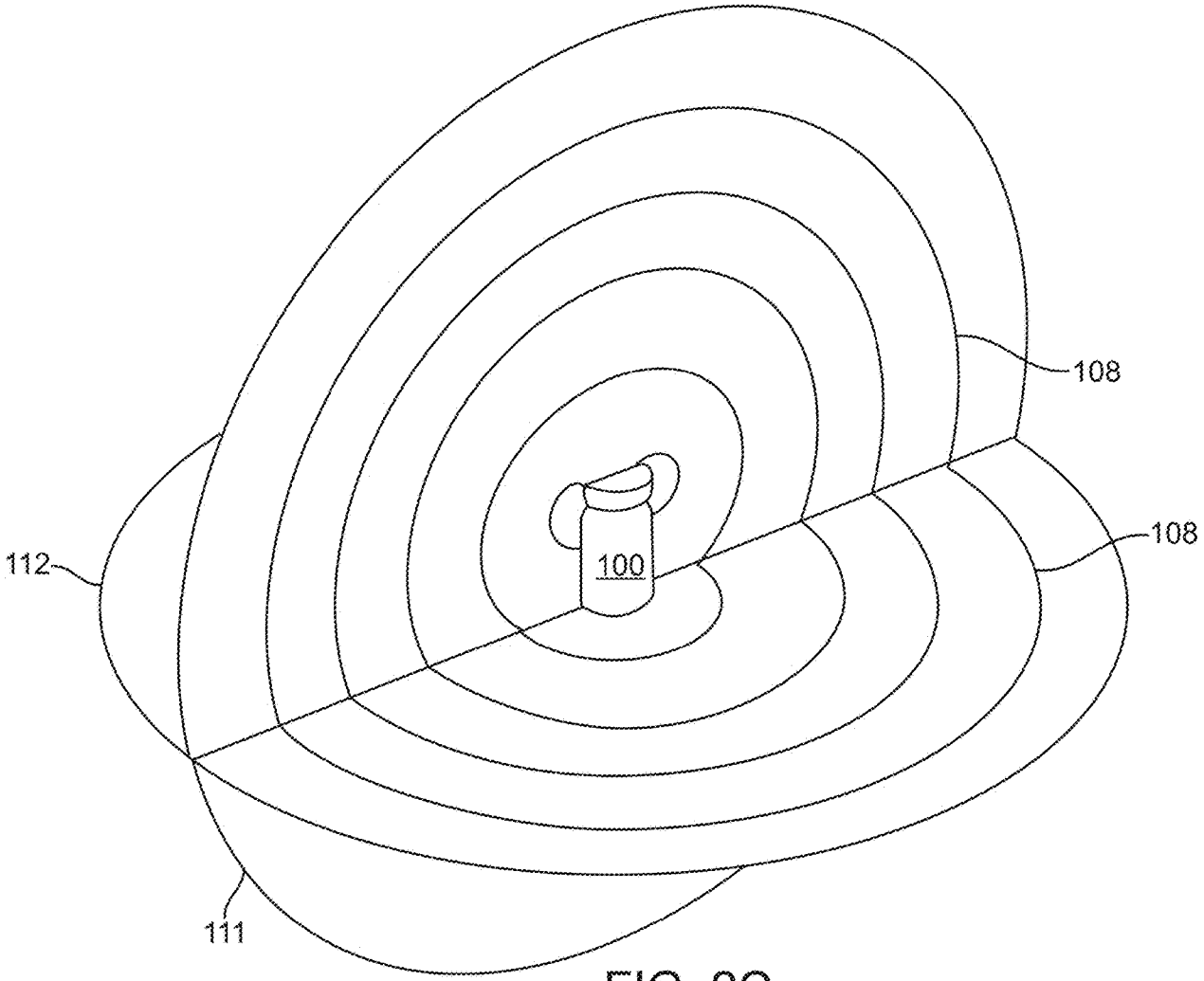
FIG. 2C illustrates sound pressure in horizontal and vertical planes around the omnidirectional loudspeaker in operation, in accordance with one embodiment.

FIG. 2C illustrates sound pressure in horizontal and vertical planes around the omnidirectional loudspeaker 100 in operation, in accordance with one embodiment. The loudspeaker 100 provides true omnidirectional sound in both a vertical plane 111 and a horizontal plane 112. The geometry of the reflectors 105A, 105B causes sound from the sound source 101 to radiate in a radial direction, thereby creating uniform sound in the horizontal plane 112 and the vertical plane 111. Sound waves 108 from the sound source 101 form concentric circles in both the horizontal plane 112 and the vertical plane 111.

Specifically, the sound source 101 generates sound waves that propagate radially along the each straight section 103A, 103B. The straight sections 103A and 103B generate cylindrical sound waves 108 that propagate along a radial direction. The straight sections 103A, 103B force the sound waves to become cylindrical sound waves with a wave front 108A (FIG. 2A) that is parallel to the axis of symmetry 102. The growth sections 104A and 104B focuses the sound waves to the radial direction, thereby counteracting axial focusing of a straight slot 50 (FIG. 1). At the distal ends $b_1$ and $b_2$ of the straight sections 103A and 103B, the cylindrical sound waves enter the growth sections 104A and 104B that forces the wave front to grow exponentially until the sound waves exit the outer circumference 106 of the reflector 105.

Figure 3A:
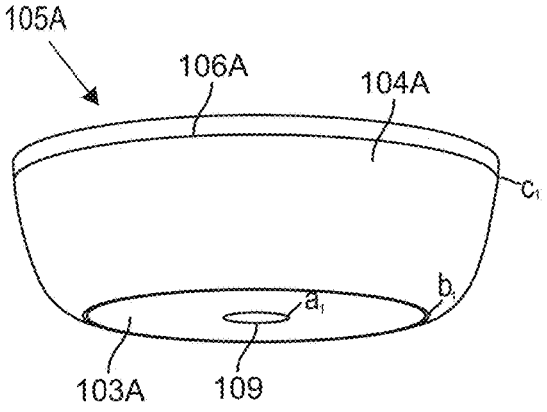
FIG. 3A illustrates a side view of the first reflector of the omnidirectional loudspeaker, in accordance with one embodiment.
Figure 3B:
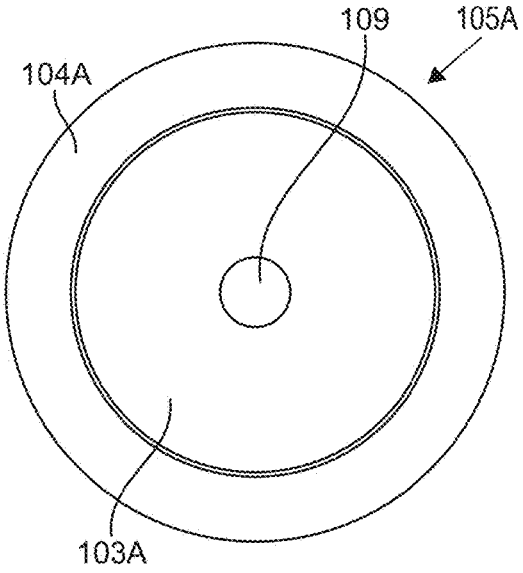
FIG. 3B illustrates a bottom view of the first reflector of the omnidirectional loudspeaker, in accordance with one embodiment.
Figure 3C:
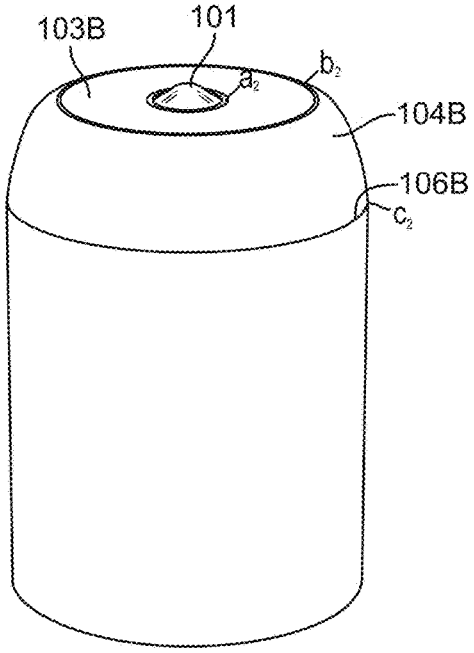
FIG. 3C illustrates a side view of the second reflector of the omnidirectional loudspeaker, in accordance with one embodiment.
Figure 3D:
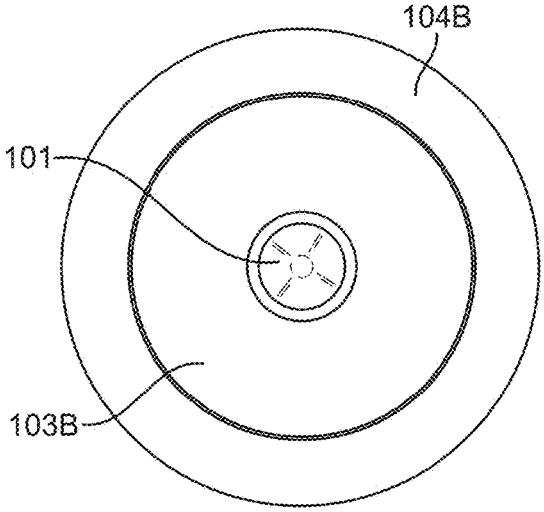
FIG. 3D illustrates a top view of the second reflector of the omnidirectional loudspeaker, in accordance with one embodiment.

FIG. 3A illustrates a side view of the first reflector 105A of the omnidirectional loudspeaker 100, in accordance with one embodiment. FIG. 3B illustrates a bottom view of the first reflector 105A of the omnidirectional loudspeaker 100, in accordance with one embodiment. FIG. 3C illustrates a side view of the second reflector 105B of the omnidirectional loudspeaker 100, in accordance with one embodiment. FIG. 3D illustrates a top view of the second reflector 105B of the omnidirectional loudspeaker 100, in accordance with one embodiment. In one embodiment, a portion of the sound source 101 that is disposed in the second reflector 105B may protrude outwards from the second reflector 105B (as shown in FIGS. 3C and 5B), and extend into the first reflector 105A of the loudspeaker 100 (as shown in FIG. 5B). As shown in FIGS. 3A-3B, the first reflector 105A may further comprise a recess 109 shaped for receiving the protruding portion of the sound source 101 (e.g., a dimple-shaped recess).

Figure 4:
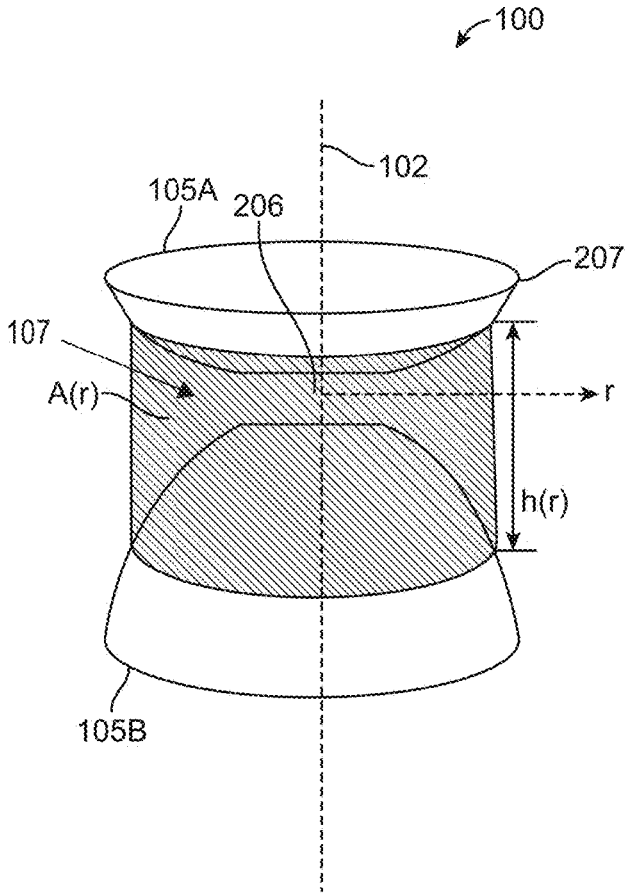
FIG. 4 illustrates a schematic drawing of the loudspeaker, in accordance with one embodiment.

FIG. 4 illustrates a schematic drawing of the loudspeaker 100, in accordance with one embodiment. The horn 107 formed by the reflectors 105A and 105B has a throat ("horn throat") 206 and a mouth ("horn mouth") 207. Let A(r) generally denote an area function for an area of sound waves generated by each reflector 105A, 105B at a radial coordinate r. The area function A(r) may be represented in accordance with equation (1) provided below:

$$A(r)=2\pi*r*h(r) \quad (1),$$

wherein h(r) denotes a height function for a height between the first reflector 105A and the second reflector 105B at a radial coordinate r.

The height function h(r) must grow faster than 1/r in order for the area function A(r) to grow continuously (i.e., d(h)/d(r)>1 for all points between b and c of the reflector). In one embodiment, if an exponential area growth is desired for the continually growing curves of the growth sections 104A and 104B, the height function h(r) is represented in accordance with equation (2) provided below:

$$h(r)=C/r*\exp(B*r) \quad (2),$$

wherein C and B denote constants that are based on a height of the horn throat 206 and a height of the horn mouth 207.

In one embodiment, for a symmetric horn with growth sections 104A and 104B having the same rate of area growth, constants C and B may be computed in accordance with equations (2.1) and (2.2) provided below:

$$C = \frac{r_t h_t}{\left(\frac{r_m h_m}{r_t h_t}\right)^{\left(\frac{r_t}{r_m - r_t}\right)}}, \text{ and} \quad (2.1)$$

$$B = \frac{\ln\frac{r_m h_m}{r_t h_t}}{r_m - r_t}, \quad (2.2)$$

wherein $r_t$ is a radial coordinate the horn throat 206 at a point on the reflector (e.g., point $b_1$), $h_t$ is a height of the horn throat 206 at the radial coordinate $r_t$, $r_m$ is a radial coordinate of the horn mouth 207 at a point on the reflector (e.g., point $c_1$), and $h_m$ is a height of the horn mouth 207 at the radial coordinate $r_m$.

Figure 5A:
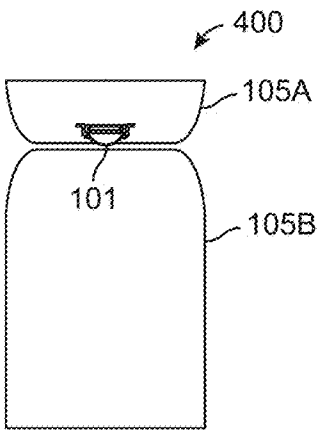
FIG. 5A illustrates another example omnidirectional loudspeaker comprising a sound source positioned in the first reflector, in accordance with one embodiment.
Figure 5B:
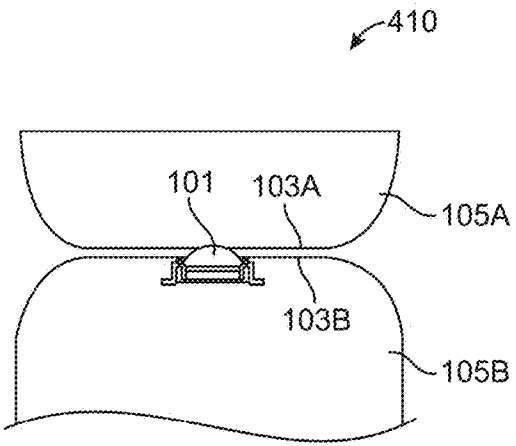
FIG. 5B illustrates another example omnidirectional loudspeaker comprising a sound source positioned differently with respect to each straight section of each reflector, in accordance with one embodiment.
Figure 5C:
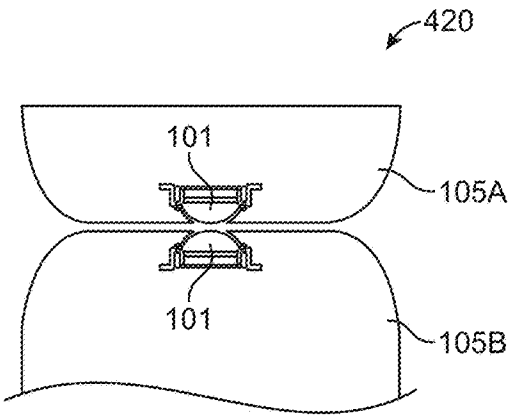
FIG. 5C illustrates another example omnidirectional loudspeaker comprising multiple sound sources, in accordance with one embodiment.

FIG. 5A illustrates another example omnidirectional loudspeaker 400, in accordance with one embodiment. The loudspeaker 400 is identical to the loudspeaker 100 in FIG. 1, with the exception that the sound source 101 in the loudspeaker 400 is positioned/mounted axially in the first reflector 105A. The alternative placement of the sound source 101 within the first reflector 105A may minimize the amount of dust that gets trapped by the loudspeaker 400.

FIG. 5B illustrates another example omnidirectional loudspeaker 410 comprising a sound source 101 positioned differently with respect to each straight section 103 of each reflector 105, in accordance with one embodiment. The loudspeaker 410 is identical to the loudspeaker 100 in FIG. 1, with the exception that an axial location of each straight section 103A, 103B of the loudspeaker 410 relative to the sound source 101 is variable based on an application and type/size/shape of the loudspeaker 410 and/or sound source 101. The axial location of the straight sections 103A, 103B balances resonances and acoustic nulls in the straight slot 50 (FIG. 1) optimally.

FIG. 5C illustrates another example omnidirectional loudspeaker 420 comprising multiple sound sources 101, in accordance with one embodiment. The loudspeaker 420 is identical to the loudspeaker 100 in FIG. 1, with the exception that the loudspeaker 420 comprises a first sound source 101 and a second sound source 101 positioned/mounted axially in the first reflector 105A and the second reflector 105B, respectively. The loudspeaker 420 has more than one sound source 101 to increase total sound output (i.e., total emitted sound power). A phase relationship between each sound source 101 may be controlled to positively affect resonance behavior in the straight slot 50 (FIG. 1).

Figure 5D:
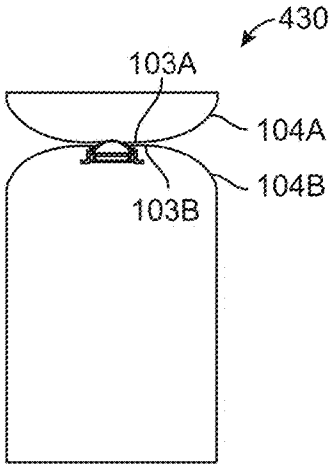
FIG. 5D illustrates an omnidirectional loudspeaker including growth sections with varying rates of area growth, in accordance with one embodiment.

FIG. 5D illustrates an omnidirectional loudspeaker 430 including growth sections 104A, 104B with varying rates of area growth, in accordance with one embodiment. The loudspeaker 430 is identical to the loudspeaker 100 in FIG. 1, with the exception that the straight sections 103A and 103B in the loudspeaker 430 have different lengths than the straight sections 103A and 103B in the loudspeaker 100. In one example implementation, the straight sections 103A and 103B in the loudspeaker 430 are shorter than the straight sections 103A and 103B in the loudspeaker 100. In another example implementation, the straight sections 103A and 103B in the loudspeaker 430 are longer than the straight sections 103A and 103B in the loudspeaker 100.

Figure 9B:
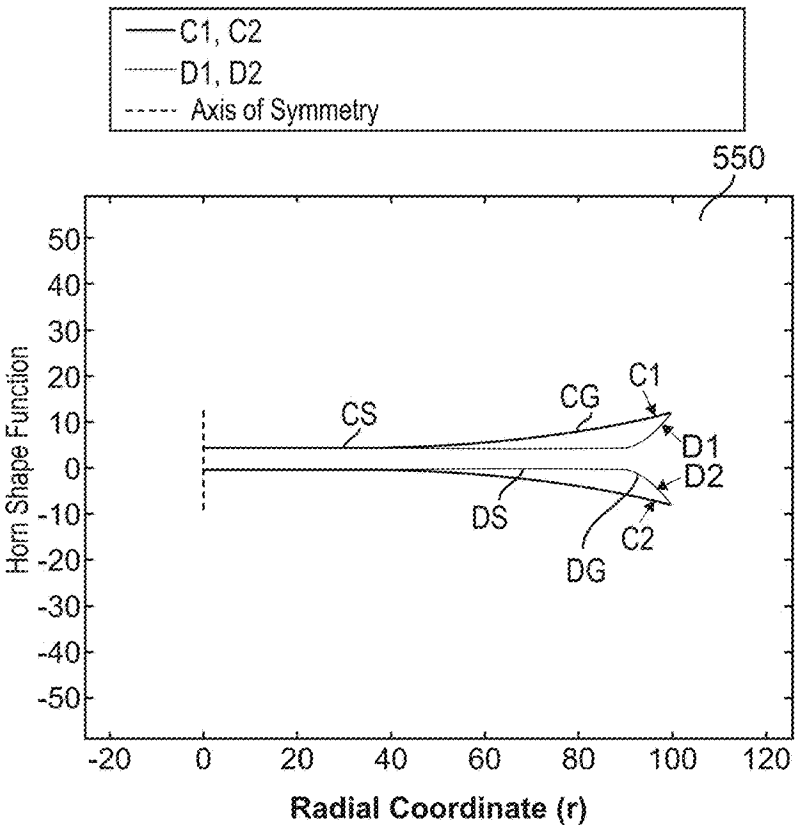
FIG. 9B is an example graph illustrating different horn profiles for a horn including a short horn throat and a short horn mouth, in accordance with an embodiment of the invention.
Figure 9A:
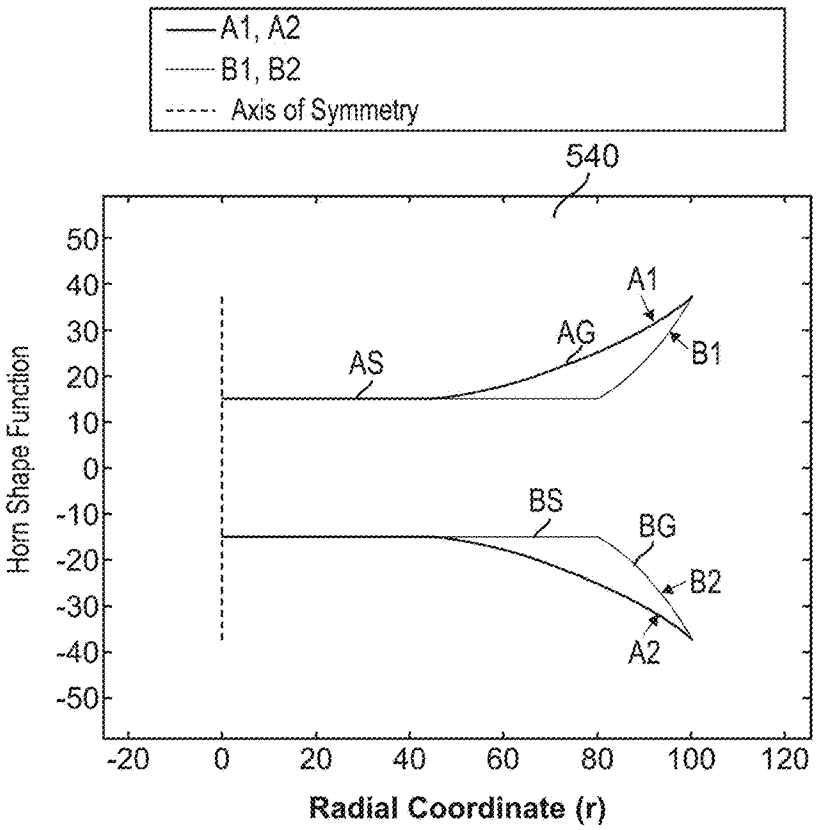
FIG. 9A is an example graph illustrating different horn profiles for a horn including a tall horn throat and a medium horn mouth, in accordance with an embodiment of the invention.

Depending on an application and type/size/shape of the loudspeaker 430 and/or the sound source 101, a gentler (i.e., slower) or sharper (i.e., faster/more aggressive) rate of area growth is preferable for the continually growing curves of the growth sections 104A and 104B. For example, a gentler rate of area growth (as shown in FIGS. 9A-9C) results in a smoother frequency response of the loudspeaker 430, but sound directivity along a vertical plane may be sub-optimal. As another example, a sharper rate of area growth (as shown in FIGS. 9A-9C) results in optimal sound directivity, but the resulting impedance match between the sound source 101 and air surrounding the loudspeaker 430 will be less gradual and may also result in unwanted resonant behavior of the horn 107.

$B*r_0$ represents a rate of area growth of a growth section of a loudspeaker, wherein B is a constant that is based on a height of a horn throat of the loudspeaker and a height of a horn mouth of the loudspeaker, and $r_0$ is a nominal radius of the loudspeaker. In one embodiment, a gentler rate of area growth may be in the range $1 \leq B*r_0 \leq 5$. In one embodiment, a sharper rate of area growth may be in the range $7 < B*r_0 \leq 15$.

Figure 6:
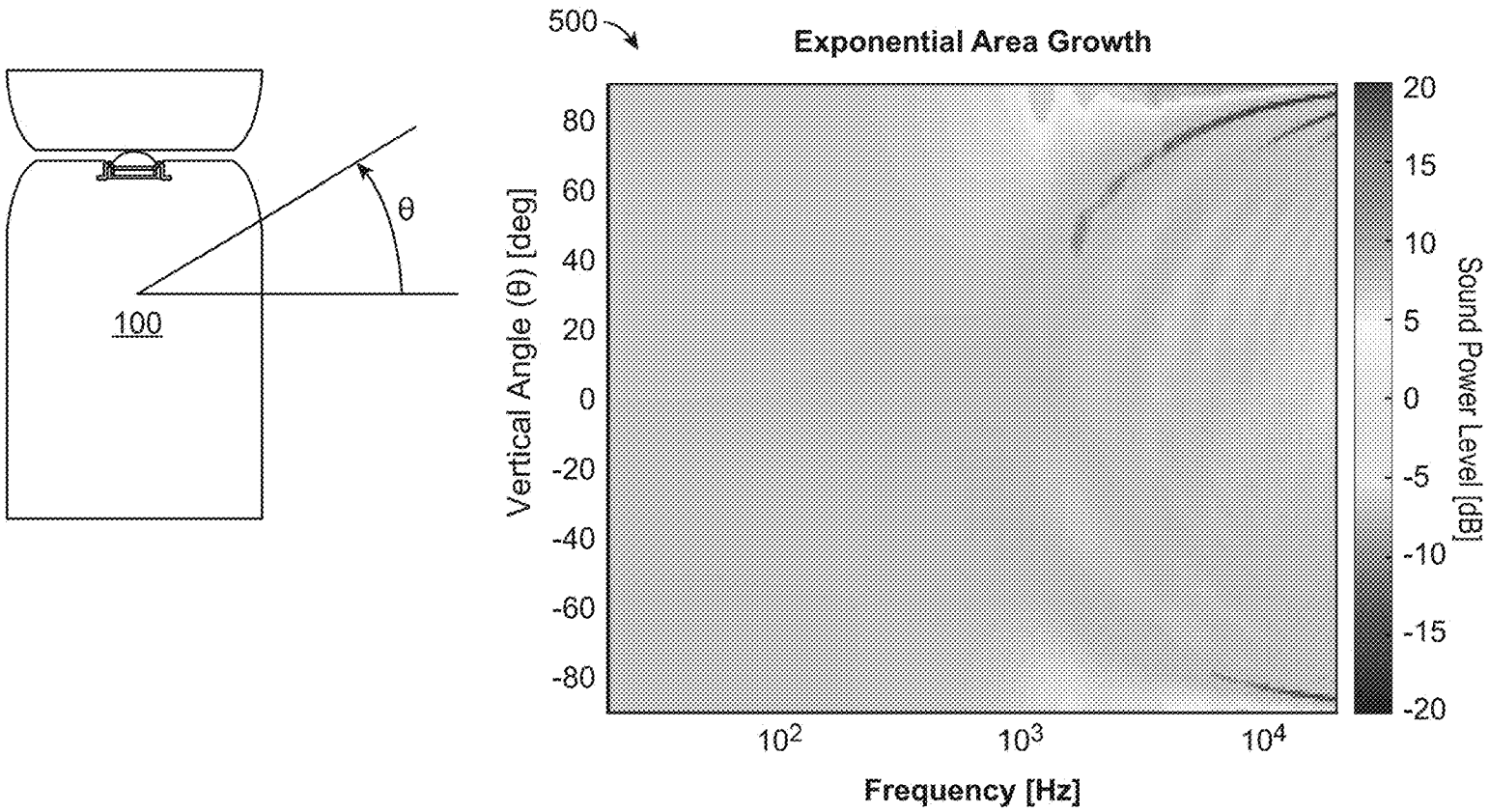
FIG. 6 is an example graph illustrating sound power level in a vertical plane around an omnidirectional loudspeaker including growth sections with an exponential rate of area growth, in accordance with one embodiment.

FIG. 6 is an example graph 500 illustrating sound power level in a vertical plane around an omnidirectional loudspeaker 100 including growth sections 104 with an exponential rate of area growth, in accordance with one embodiment. Each growth section 104 of each reflector 105 forces the wave front of sound waves generated by the sound source 101 to grow exponentially until the sound waves exit the outer circumference 106 of the reflector 105. Further, total emitted sound power of the loudspeaker 100 is relatively consistent over a range of frequencies and vertical angles θ in the vertical plane of the loudspeaker 100.

Figure 7B:
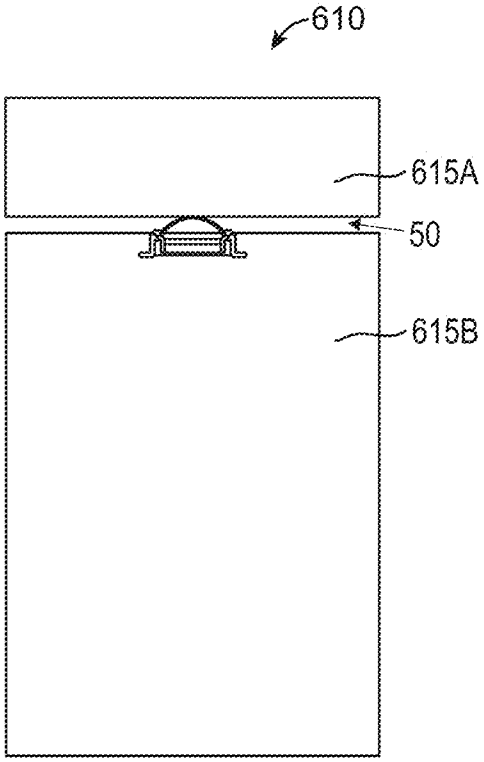
FIG. 7B illustrates an example conventional straight slot loudspeaker.
Figure 7A:
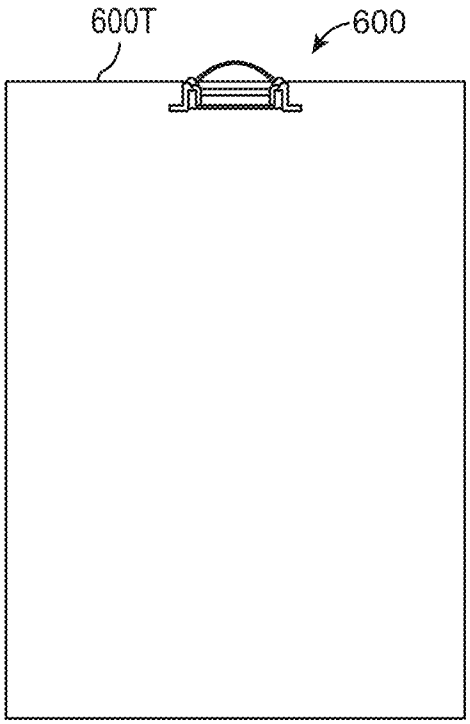
FIG. 7A illustrates an example conventional flat top loudspeaker.

FIG. 7A illustrates an example conventional flat top loudspeaker 600. Unlike the loudspeaker 100 in FIG. 1, the loudspeaker 600 has a flat top 600T. The loudspeaker 600 does not have any reflectors to form a straight slot.

FIG. 7B illustrates an example conventional straight slot loudspeaker 610. The loudspeaker 610 comprises a first reflector 615A and a second reflector 615B that together form a straight slot 50. Unlike the cup-shaped reflectors 105A and 105B of the loudspeaker 100 in FIG. 1, the reflectors 615A and 615B in FIG. 7B do not have any growth sections (i.e., each reflector 615A, 615B comprises straight sections only).

Figure 8A:
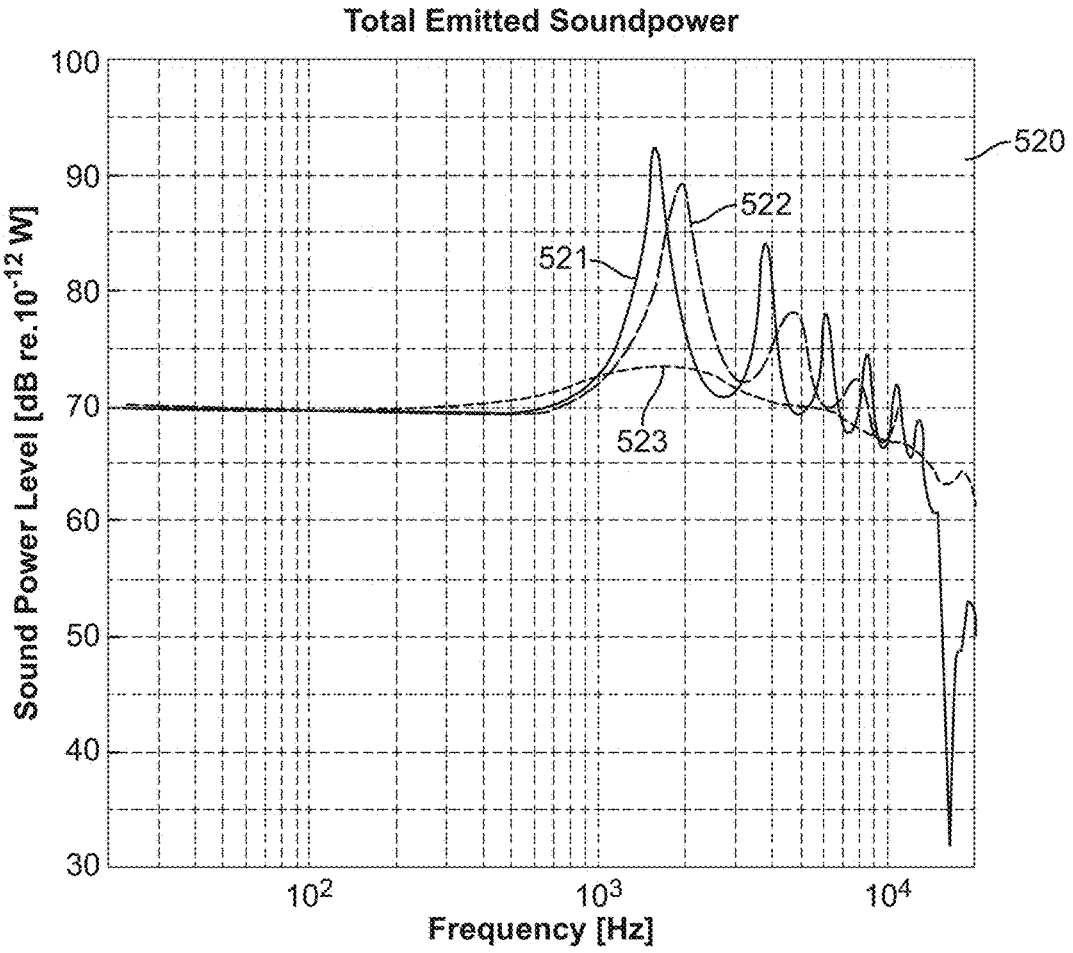
FIG. 8A is an example graph comparing total emitted sound power of the loudspeaker in FIG. 1 against total emitted sound power of the flat top loudspeaker in FIG. 7A and the straight slot loudspeaker in FIG. 7B, in accordance with an embodiment of the invention.

FIG. 8A is an example graph 520 comparing total emitted sound power of the loudspeaker 100 (FIG. 1) against total emitted sound power of the flat top loudspeaker 600 (FIG. 7A) and the straight slot loudspeaker 610 (FIG. 7B), in accordance with an embodiment of the invention. The graph 520 comprises a first curve 521 representing total emitted sound power of the straight slot loudspeaker 610, a second curve 523 representing total emitted sound power of the flat top loudspeaker 600, and a third curve 522 representing total emitted sound power of the loudspeaker 100.

Figure 8B:
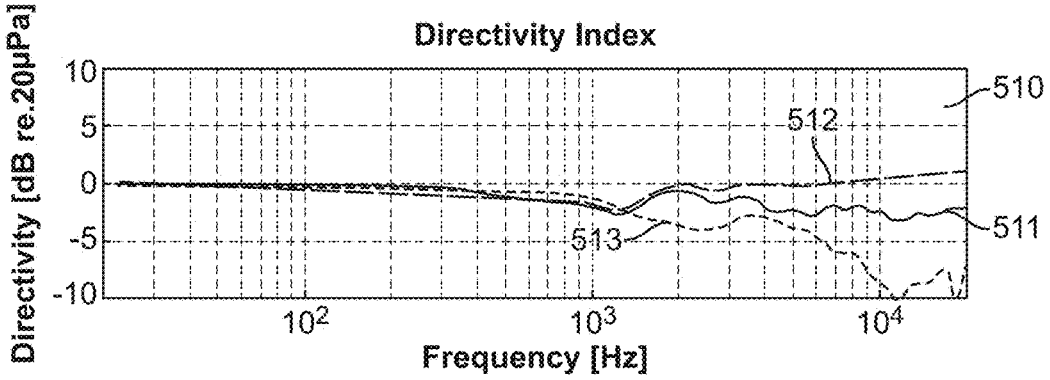
FIG. 8B is an example graph comparing sound directivity of the loudspeaker in FIG. 1 against sound directivity of the flat top loudspeaker in FIG. 7A and the straight slot loudspeaker in FIG. 7B, in accordance with an embodiment of the invention.

FIG. 8B is an example graph 510 comparing sound directivity of the loudspeaker 100 (FIG. 1) against sound directivity of the flat top loudspeaker 600 (FIG. 7A) and the straight slot loudspeaker 610 (FIG. 7B), in accordance with an embodiment of the invention. The graph 510 comprises a first curve 511 representing sound directivity of the straight slot loudspeaker 610, a second curve 513 representing sound directivity of the flat top loudspeaker 600, and a third curve 512 representing sound directivity of the loudspeaker 100. As shown by the curves 511-513, sound directivity of the loudspeaker 100 is relatively consistent over a range of frequencies in comparison to sound directivity of the straight slot loudspeaker 610 and the flat top loudspeaker 600.

FIG. 9A is an example graph 540 illustrating different horn profiles for a horn 107 including a tall horn throat 206 and a medium horn mouth 207, in accordance with an embodiment of the invention. Assume a horn 107 formed by the reflectors 105A and 105B has a tall horn throat 206 and a medium horn mouth 207. For example, if each reflector 105A, 105B has an exit radius (i.e., outer circumference 106) of about 100 mm, a height of the tall horn throat 206 is about 30 mm, and a height of the medium horn mouth 207 is about 75 mm.

In one example implementation, the horn 107 with the tall horn throat 206 and the medium horn mouth 207 may be designed in accordance with a first horn profile comprising shape A1 for the first reflector 105A and shape A2 for the second reflector 105A. Each shape A1, A2 comprises a straight section AS and a growth section AG.

In another example implementation, the horn 107 with the tall horn throat 206 and the medium horn mouth 207 may be designed in accordance with a second horn profile comprising shape B1 for the first reflector 105A and shape B2 for the second reflector 105A. Each shape B1, B2 comprises a straight section BS and a growth section BG.

As shown in FIG. 9A, straight section AS is shorter than straight section BS. Further, growth section AG has a gentler rate of area growth than growth section BG (i.e., growth section AG has a slower rate of area growth compared to growth section BG which has a more aggressive rate of area growth). In one embodiment, the rates of area growth for growth sections AG and BG are about 3.1 and 5.7, respectively.

FIG. 9B is an example graph 550 illustrating different horn profiles for a horn 107 including a short horn throat 206 and a short horn mouth 207, in accordance with an embodiment of the invention. Assume a horn 107 formed by the reflectors 105A and 105B has a short horn throat 206 and a short horn mouth 207. For example, if each reflector 105A, 105B has an exit radius (i.e., outer circumference 106) of about 100 mm, a height of the short horn throat 206 is about 5 mm, and a height of the short horn mouth 207 is about 20 mm.

In one example implementation, the horn 107 with the short horn throat 206 and the short horn mouth 207 may be designed in accordance with a first horn profile comprising shape C1 for the first reflector 105A and shape C2 for the second reflector 105A. Each shape C1, C2 comprises a straight section CS and a growth section CG.

In another example implementation, the horn 107 with the short horn throat 206 and the short horn mouth 207 may be designed in accordance with a second horn profile comprising shape D1 for the first reflector 105A and shape D2 for the second reflector 105A. Each shape D1, D2 comprises a straight section DS and a growth section DG.

As shown in FIG. 9B, straight section CS is shorter than straight section DS. Further, growth section CG has a gentler rate of area growth than growth section DG (i.e., growth section CG has a slower rate of area growth compared to growth section DG which has a more aggressive rate of area growth).

In one embodiment, the rates of area growth for growth sections CG and DG are about 3.7 and 14.9, respectively.

FIG. 9C is an example graph 560 illustrating different horn profiles for a horn 107 including a medium horn throat 206 and a tall horn mouth 207, in accordance with an embodiment of the invention. Assume a horn 107 formed by the reflectors 105A and 105B has a medium horn throat 206 and a tall horn mouth 207. For example, if each reflector 105A, 105B has an exit radius (i.e., outer circumference 106) of about 100 mm, a height of the medium horn throat 206 is about 10 mm, and a height of the tall horn mouth 207 is about 120 mm.

In one example implementation, the horn 107 with the medium horn throat 206 and the tall horn mouth 207 may be designed in accordance with a first horn profile comprising shape E1 for the first reflector 105A and shape E2 for the second reflector 105A. Each shape E1, E2 comprises a straight section ES and a growth section EG.

In another example implementation, the horn 107 with the medium horn throat 206 and the tall horn mouth 207 may be designed in accordance with a second horn profile comprising shape F1 for the first reflector 105A and shape F2 for the second reflector 105A. Each shape F1, F2 comprises a straight section FS and a growth section FG.

As shown in FIG. 9C, straight section ES is shorter than straight section FS. Further, growth section EG has a gentler rate of area growth than growth section FG (i.e., growth section EG has a slower rate of area growth compared to growth section FG which has a more aggressive rate of area growth).

In one embodiment, the rates of area growth for growth sections EG and FG are about 5.2 and 11.1, respectively.

Figure 9D:
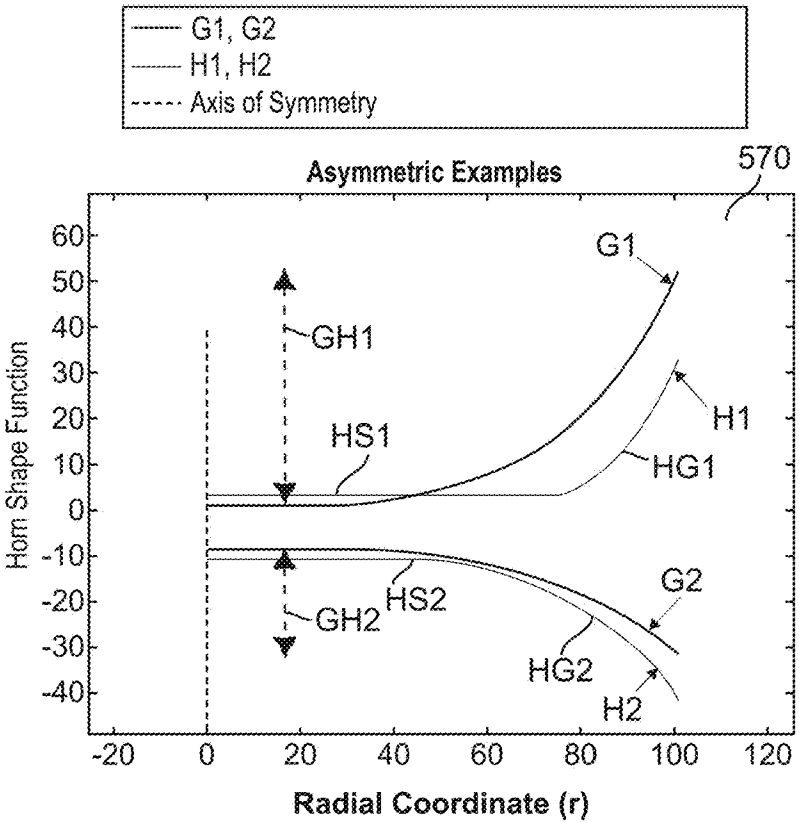
FIG. 9D is an example graph illustrating different asymmetric horn profiles for a horn, in accordance with an embodiment of the invention.
Figure 9C:
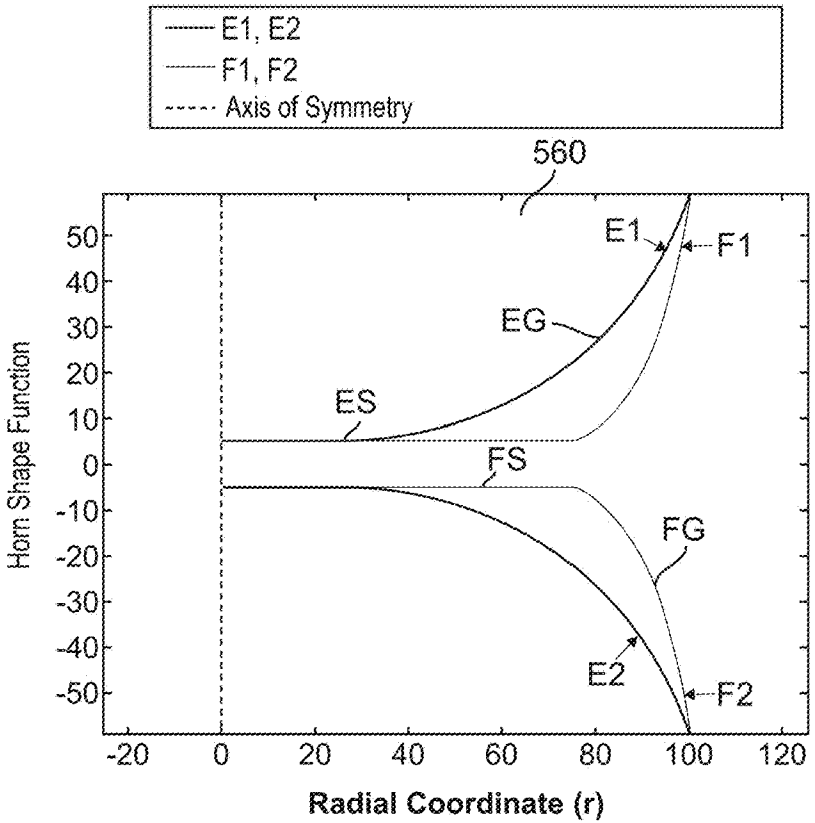
FIG. 9C is an example graph illustrating different horn profiles for a horn including a medium horn throat and a tall horn mouth, in accordance with an embodiment of the invention.

FIG. 9D is an example graph 570 illustrating different asymmetric horn profiles for a horn 107, in accordance with an embodiment of the invention. In one example implementation, the horn 107 may be designed in accordance with a first asymmetric horn profile comprising shape G1 for the first reflector 105A and shape G2 for the second reflector 105A. As shown in FIG. 9D, shapes G1 and G2 have horn mouths with different heights. Specifically, shape G1 has a corresponding horn mouth with height GH1 that is taller than height GH2 for a horn mouth corresponding to shape G2. In one embodiment, the rates of area growth for growth sections of G1 and G2 are 5.1 and 4.2, respectively.

In another example implementation, the horn 107 may be designed in accordance with a second asymmetric horn profile comprising shape H1 for the first reflector 105A and shape H2 for the second reflector 105A. As shown in FIG. 9D, shapes H1 and H2 have straight sections with different lengths. Specifically, shape H1 has a corresponding straight section HS1 that is shorter than a straight section HS2 corresponding to shape H2. Further, shape H1 has a corresponding growth section HG1 that has a sharper rate of area growth than growth section HG2 (i.e., growth section HG1 has a more aggressive rate of area growth compared to growth section HG2 which has a gentler rate of area growth). In one embodiment, the rates of area growth for growth sections HG1 and HG2 are about 7.8 and 4.7, respectively.

Figure 10:
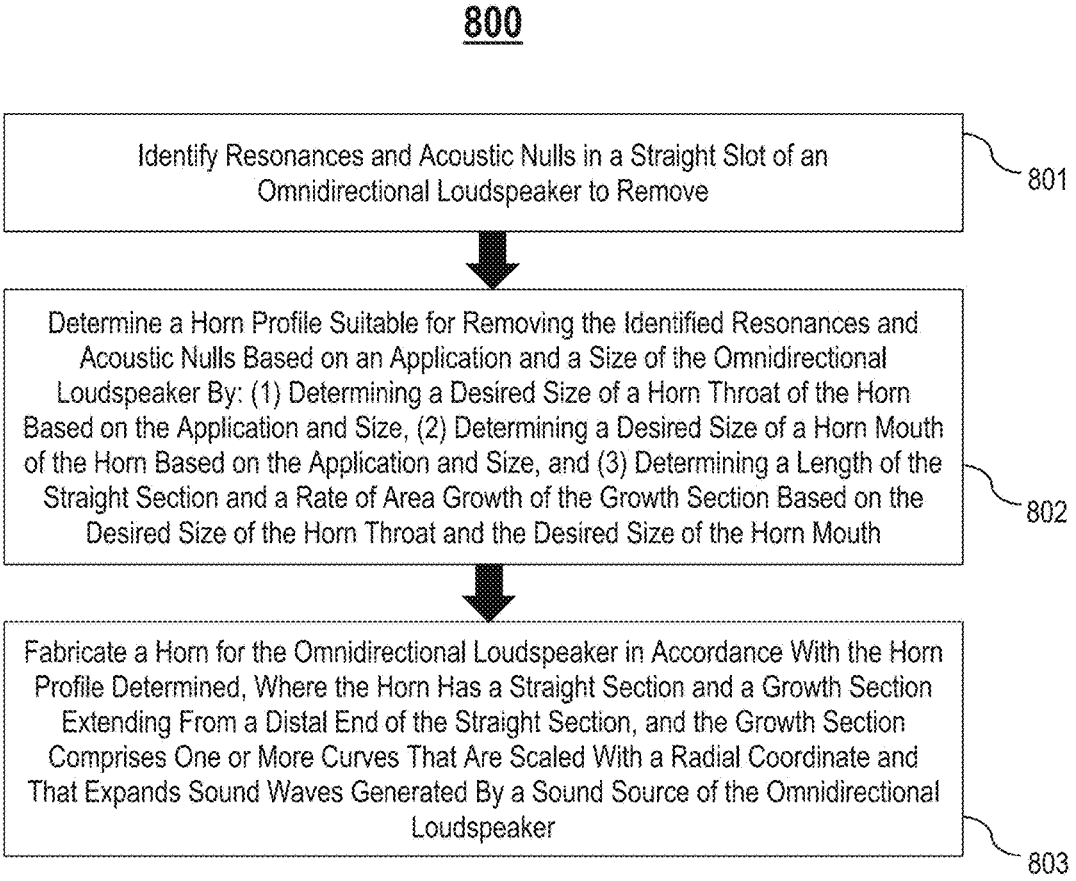
FIG. 10 is an example flowchart of a manufacturing process for producing a horn for an omnidirectional loudspeaker, in accordance with an embodiment of the invention.

FIG. 10 is an example flowchart of a manufacturing process 800 for producing a horn for an omnidirectional loudspeaker, in accordance with an embodiment of the invention. In process block 801, identify resonances and acoustic nulls in a straight slot of the omnidirectional loudspeaker to remove.

In process block 802, determine a horn profile suitable for removing the identified resonances and acoustic nulls based on an application and a size of the omnidirectional loudspeaker by (1) determining a desired size of a horn throat of the horn based on the application and size, (2) determining a desired size of a horn mouth of the horn based on the application and size, and (3) determining a length of the straight section and a rate of area growth of the growth section based on the desired size of the horn throat and the desired size of the horn mouth.

In process block 803, fabricate a horn for the omnidirectional loudspeaker in accordance with the horn profile determined, where the horn has a straight section and a growth section extending from a distal end of the straight section, and the growth section comprises one or more curves that are scaled with a radial coordinate and that expands sound waves generated by a sound source of the omnidirectional loudspeaker.

Figure 11:
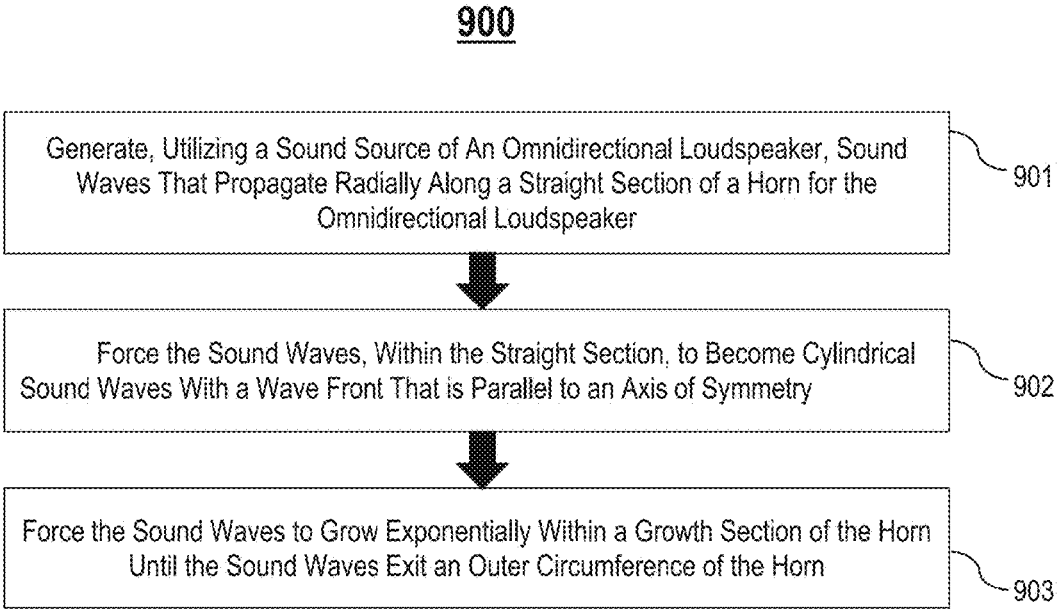
FIG. 11 is an example flowchart for creating uniform sound in a horizontal plane and a vertical plane, in accordance with an embodiment of the invention.

FIG. 11 is an example flowchart 900 for creating uniform sound in a horizontal plane and a vertical plane, in accordance with an embodiment of the invention. In process block 901, generate, utilizing a sound source of an omnidirectional loudspeaker, sound waves that propagate radially along a straight section of a horn for the omnidirectional loudspeaker. In process block 902, force the sound waves, within the straight section, to become cylindrical sound waves with a wave front that is parallel to an axis of symmetry. In process block 903, force the sound waves to grow exponentially within a growth section of the horn until the sound waves exit an outer circumference of the horn.

Though the embodiments have been described with reference to certain versions thereof; however, other versions are possible. Therefore, the spirit and scope of the appended claims should not be limited to the description of the preferred versions contained herein.

What is claimed is:

1. An omnidirectional loudspeaker, comprising:

a first axisymmetric reflector;

a second axisymmetric reflector;

a sound source in the first axisymmetric reflector or the second axisymmetric reflector; and a horn including a straight section extending straight and a growth section extending from a distal end of the straight section, wherein the straight section has a length based on a size of a throat of the horn and a size of a mouth of the horn, wherein the growth section comprises one or more curves that are scaled with a radial coordinate and a rate of area growth based on the size of the throat and the size of the mouth, and wherein sound waves generated by the sound source become cylindrical as the sound waves propagate radially along the straight section and expand as the sound waves enter the growth section.

2. The omnidirectional loudspeaker of claim 1, wherein the horn is a three hundred and sixty degree (360°) horn that is rotationally symmetric about an axis of symmetry, the straight section forces the sound waves to become cylindrical with a wave front that is parallel to the axis of symmetry, and the growth section forces the wave front to grow exponentially until the sound waves exit the omnidirectional loudspeaker.

3. The omnidirectional loudspeaker of claim 1, wherein the one or more curves grow as the radial coordinate increases.

4. The omnidirectional loudspeaker of claim 1, wherein the growth section of the horn expands exponentially.

5. The omnidirectional loudspeaker of claim 1, wherein a corresponding height of the one or more curves grows faster than an inverse of the radial coordinate.

6. The omnidirectional loudspeaker of claim 1, wherein the rate of area growth comprises a gentle rate of area growth.

7. The omnidirectional loudspeaker of claim 1, wherein the rate of area growth comprises a sharp rate of area growth.

8. The omnidirectional loudspeaker of claim 1, wherein each axisymmetric reflector has a corresponding outer circumference that allows sound to exit the omnidirectional loudspeaker.

9. The omnidirectional loudspeaker of claim 1, further comprising an additional sound source, wherein the additional sound source of the omnidirectional loudspeaker is disposed in a different axisymmetric reflector than the sound source of the omnidirectional loudspeaker.

10. The omnidirectional loudspeaker of claim 1, wherein:

the growth section expands exponentially;

a height between the first axisymmetric reflector and the second axisymmetric reflector is based on the radial coordinate;

the height grows as C/r*exp(B*r), wherein C and B denote constants based on one or more dimensions of the throat and the mouth of the horn, and r denotes the radial coordinate;

for each axisymmetric reflector, the straight section extends straight from a first point of the axisymmetric reflector to a second point of the axisymmetric reflector, the growth section extends curved from the second point to a third point of the axisymmetric reflector, and the second point is the distal end of the straight section; and an axial location of the straight section relative to the sound source is based on at least one of the omnidirectional loudspeaker or the sound source, and the axial location balances resonances and acoustic nulls in a straight slot of the omnidirectional loudspeaker.

11. A horn device for an omnidirectional loudspeaker, comprising:

a straight section extending straight, wherein the straight section has a length based on a size of a throat of the horn device and a size of a mouth of the horn device; and a growth section extending from a distal end of the straight section, wherein the growth section comprises one or more curves that are scaled with a radial coordinate and a rate of area growth based on the size of the throat and the size of the mouth, and wherein sound waves generated by a sound source of the omnidirectional loudspeaker become cylindrical as the sound waves propagate radially along the straight section and expand as the sound waves enter the growth section.

12. The horn device of claim 11, wherein the horn device is a three hundred and sixty degree (360°) horn that is rotationally symmetric about an axis of symmetry, the straight section forces the sound waves to become cylindrical with a wave front that is parallel to the axis of symmetry, and the growth section forces the wave front to grow exponentially until the sound waves exit the omnidirectional loudspeaker.

13. The horn device of claim 11, wherein the one or more curves grow as the radial coordinate increases.

14. The horn device of claim 11, wherein the growth section expands exponentially.

15. The horn device of claim 11, wherein a corresponding height of the one or more curves grows faster than an inverse of the radial coordinate.

16. The horn device of claim 11, wherein the rate of area growth comprises a gentle rate of area growth.

17. The horn device of claim 11, wherein the rate of area growth comprises a sharp rate of area growth.

18. A method for creating uniform sound in a horizontal plane and a vertical plane, comprising:

generating, utilizing a sound source of an omnidirectional loudspeaker, sound waves that propagate radially along a straight section extending straight of a horn for the omnidirectional loudspeaker, wherein the straight section has a length based on a size of a throat of the horn and a size of a mouth of the horn;

forcing the sound waves, within the straight section, to become cylindrical sound waves with a wave front that is parallel to an axis of symmetry; and forcing the sound waves to grow exponentially within a growth section of the horn until the sound waves exit an outer circumference of the horn, wherein the growth section comprises one or more curves that are scaled with a radial coordinate and a rate of area growth based on the size of the throat and the size of the mouth.

* * * * *